US007191125B2

(12) United States Patent
Huang

(10) Patent No.: US 7,191,125 B2
(45) Date of Patent: Mar. 13, 2007

(54) METHOD AND APPARATUS FOR HIGH PERFORMANCE LOW BIT-RATE CODING OF UNVOICED SPEECH

(75) Inventor: Pengjun Huang, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 11/066,356

(22) Filed: Feb. 24, 2005

(65) Prior Publication Data

US 2005/0143980 A1 Jun. 30, 2005

Related U.S. Application Data

(63) Continuation of application No. 09/690,915, filed on Oct. 17, 2000, now Pat. No. 6,947,888.

(51) Int. Cl.
*G10L 21/02* (2006.01)

(52) U.S. Cl. ..... 704/226; 704/222

(58) Field of Classification Search ..... None
See application file for complete search history.

(56) References Cited

U.S. PATENT DOCUMENTS 5,615,298 A * 3/1997 Chen ..... 704/228
5,651,091 A * 7/1997 Chen ..... 704/223
5,909,663 A * 6/1999 Iijima et al. ..... 704/226
6,047,253 A * 4/2000 Nishiguchi et al. ..... 704/207

* cited by examiner

*Primary Examiner*—Abul K. Azad
(74) *Attorney, Agent, or Firm*—Thomas Rouse; Charles D. Brown; Alex C. Chen

(57) ABSTRACT

A low-bit-rate coding technique for unvoiced segments of speech, without loss of quality compared to the conventional Code Excited Linear Prediction (CELP) method operating at a much higher bit rate. A set of gains are derived from a residual signal after whitening the speech signal by a linear prediction filter. These gains are then quantized and applied to a randomly generated sparse excitation. The excitation is filtered, and its spectral characteristics are analyzed and compared to the spectral characteristics of the original residual signal. Based on this analysis, a filter is chosen to shape the spectral characteristics of the excitation to achieve optimal performance.

36 Claims, 9 Drawing Sheets

206

METHOD AND APPARATUS FOR HIGH PERFORMANCE LOW BIT-RATE CODING OF UNVOICED SPEECH

CLAIM OF PRIORITY UNDER 35 U.S.C. §120

The present Application for Patent is a continuation of patent application Ser. No. 09/690,915 entitled "METHOD AND APPARATUS FOR HIGH PERFORMANCE LOW BIT-RATE CODING OF UNVOICED SPEECH" filed Oct. 17, 2000 now U.S. Pat. No. 6,947,888, pending, and assigned to the assignee hereof and hereby expressly incorporated by reference herein.

BACKGROUND

I. Field of the Invention

The disclosed embodiments relate to the field of speech processing. More particularly, the disclosed embodiments relate to a novel and improved method and apparatus for low bit-rate coding of unvoiced segments of speech.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder, or a codec. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and then resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Speech coders may be implemented as time-domain coders, which attempt to capture the time-domain speech waveform by employing high time-resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques described in A. Gersho & R. M. Gray, Vector Quantization and Signal Compression (1992).

A well-known time-domain speech coder is the Code Excited Linear Predictive (CELP) coder described in L. B. Rabiner & R. W. Schafer, Digital Processing of Speech Signals 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding of the LP short-term filter coefficients and encoding the LP residue. Time-domain coding can be performed at a fixed rate (i.e., using the same number of bits, $N_0$, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796, which is assigned to the assignee of the presently disclosed embodiments and fully incorporated herein by reference.

Time-domain coders such as the CELP coder typically rely upon a high number of bits, $N_0$, per frame to preserve the accuracy of the time-domain speech waveform. Such coders typically deliver excellent voice quality provided the number of bits, $N_0$, per frame relatively large (e.g., 8 kbps or above). However, at low bit rates (4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications.

Typically, CELP schemes employ a short term prediction (STP) filter and a long term prediction (LTP) filter. An Analysis by Synthesis (AbS) approach is employed at an encoder to find the LTP delays and gains, as well as the best stochastic codebook gains and indices. Current state-of-the-art CELP coders such as the Enhanced Variable Rate Coder (EVRC) can achieve good quality synthesized speech at a data rate of approximately 8 kilobits per second.

It is also known that unvoiced speech does not exhibit periodicity. The bandwidth consumed encoding the LTP filter in the conventional CELP schemes is not as efficiently utilized for unvoiced speech as for voiced speech, where periodicity of speech is strong and LTP filtering is meaningful. Therefore, a more efficient (i.e lower bit rate) coding scheme is desirable for unvoiced speech.

For coding at lower bit rates, various methods of spectral, or frequency-domain, coding of speech have been developed, in which the speech signal is analyzed as a time-varying evolution of spectra. See, e.g., R. J. McAulay & T. F. Quatieri, Sinusoidal Coding, in Speech Coding and Synthesis ch. 4 (W. B. Kleijn & K. K. Paliwal eds., 1995). In spectral coders, the objective is to model, or predict, the short-term speech spectrum of each input frame of speech with a set of spectral parameters, rather than to precisely mimic the time-varying speech waveform. The spectral parameters are then encoded and an output frame of speech is created with the decoded parameters. The resulting synthesized speech does not match the original input speech waveform, but offers similar perceived quality. Examples of frequency-domain coders that are well known in the art include multiband excitation coders (MBEs), sinusoidal transform coders (STCs), and harmonic coders (HCs). Such frequency-domain coders offer a high-quality parametric model having a compact set of parameters that can be accurately quantized with the low number of bits available at low bit rates.

Nevertheless, low-bit-rate coding imposes the critical constraint of a limited coding resolution, or a limited codebook space, which limits the effectiveness of a single coding mechanism, rendering the coder unable to represent various types of speech segments under various background conditions with equal accuracy. For example, conventional low-bit-rate, frequency-domain coders do not transmit phase information for speech frames. Instead, the phase information is reconstructed by using a random, artificially generated, initial phase value and linear interpolation techniques. See, e.g., H. Yang et al., Quadratic Phase Interpolation for Voiced Speech Synthesis in the MBE Model, in 29 Electronic Letters 856–57 (May 1993). Because the phase information is artificially generated, even if the amplitudes of the sinusoids are perfectly preserved by the quantization-unquantization process, the output speech produced by the frequency-domain coder will not be aligned with the original input speech (i.e., the major pulses will not be in sync). It has therefore proven difficult to adopt any closed-loop performance measure, such as, e.g., signal-to-noise ratio (SNR) or perceptual SNR, in frequency-domain coders.

One effective technique to encode speech efficiently at low bit rate is multimode coding. Multimode coding techniques have been employed to perform low-rate speech coding in conjunction with an open-loop mode decision process. One such multimode coding technique is described in Amitava Das et al., Multimode and Variable-Rate Coding of Speech, in Speech Coding and Synthesis ch. 7 (W. B. Kleijn & K. K. Paliwal eds., 1995). Conventional multimode coders apply different modes, or encoding-decoding algorithms, to different types of input speech frames. Each mode, or encoding-decoding process, is customized to represent a certain type of speech segment, such as, e.g., voiced speech, unvoiced speech, or background noise (nonspeech) in the most efficient manner. An external, open loop mode decision mechanism examines the input speech frame and makes a decision regarding which mode to apply to the frame. An external, open-loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation. The mode decision is thus made without knowing in advance the exact condition of the output speech, i.e., how close the output speech will be to the input speech in terms of voice quality or other performance measures. An exemplary open-loop mode decision for a speech codec is described in U.S. Pat. No. 5,414,796, which is assigned to the assignee of the presently disclosed embodiments and fully incorporated herein by reference.

Multimode coding can be fixed-rate, using the same number of bits $N_0$ for each frame, or variable-rate, in which different bit rates are used for different modes. The goal in variable-rate coding is to use only the amount of bits needed to encode the codec parameters to a level adequate to obtain the target quality. As a result, the same target voice quality as that of a fixed-rate, higher-rate coder can be obtained at a significant lower average-rate using variable-bit-rate (VBR) techniques. An exemplary variable rate speech coder is described in U.S. Pat. No. 5,414,796, assigned to the assignee of the presently disclosed embodiements and previously fully incorporated herein by reference.

There is presently a surge of research interest and strong commercial needs to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

Multimode VBR speech coding is therefore an effective mechanism to encode speech at low bit rate. Conventional multimode schemes require the design of efficient encoding schemes, or modes, for various segments of speech (e.g., unvoiced, voiced, transition) as well as a mode for background noise, or silence. The overall performance of the speech coder depends on how well each mode performs, and the average rate of the coder depends on the bit rates of the different modes for unvoiced, voiced, and other segments of speech. In order to achieve the target quality at a low average rate, it is necessary to design efficient, high-performance modes, some of which must work at low bit rates. Typically, voiced and unvoiced speech segments are captured at high bit rates, and background noise and silence segments are represented with modes working at a significantly lower rate. Thus, there is a need for a high performance low-bit-rate coding technique that accurately captures a high percentage of unvoiced segments of speech while using a minimal number of bits per frame.

SUMMARY

The disclosed embodiments are directed to a high performance low-bit-rate coding technique that accurately captures unvoiced segments of speech while using a minimal number of bits per frame. Accordingly, in one aspect of the invention, a method of decoding unvoiced segments of speech, includes recovering a group of quantized gains using received indices for a plurality of sub-frames; generating a random noise signal comprising random numbers for each of the plurality of sub-frames; selecting a pre-determined percentage of the highest-amplitude random numbers of the random noise signal for each of the plurality of sub-frames; scaling the selected highest-amplitude random numbers by the recovered gains for each sub-frame to produce a scaled random noise signal; band-pass filtering and shaping the scaled random noise signal; and selecting a second filter based on a received filter selection indicator and further shaping the scaled random noise signal with the selected filter.

BRIEF DESCRIPTION OF THE DRAWINGS

The features, objects, and advantages of the disclosed embodiments will become more apparent from the detailed description set forth below when taken in conjunction with the drawings in which like reference characters identify correspondingly throughout and wherein.

DETAILED DESCRIPTION OF THE PREFERRED EMBODIMENTS

The disclosed embodiments provide a method and apparatus for high performance low bit rate coding of unvoiced speech. Unvoiced speech signals are digitized and converted into frames of samples. Each frame of unvoiced speech is filtered by a short term prediction filter to produce short term signal blocks. Each frame is divided into multiple sub-frames. A gain is then calculated for each sub-frame. These gains are subsequently quantized and transmitted. Then, a block of random noise is generated and filtered by methods described in detail below. This filtered random noise is scaled by the quantized sub-frame gains to form a quantized signal that represents the short term signal. At a decoder, a frame of random noise is generated and filtered in the same manner as the random noise at the encoder. The filtered random noise at the decoder is then scaled by the received sub-frame gains, and passed through a short term prediction filter to form a frame of synthesized speech representing the original samples.

The disclosed embodiments present a novel coding technique for a variety of unvoiced speech. At 2 kilobits per second, the synthesized unvoiced speech is perceptually equivalent to that produced by conventional CELP schemes requiring much higher data rates. A high percentage (approximately twenty percent) of unvoiced speech segments can be encoded in accordance with the disclosed embodiments.

Figure 1:
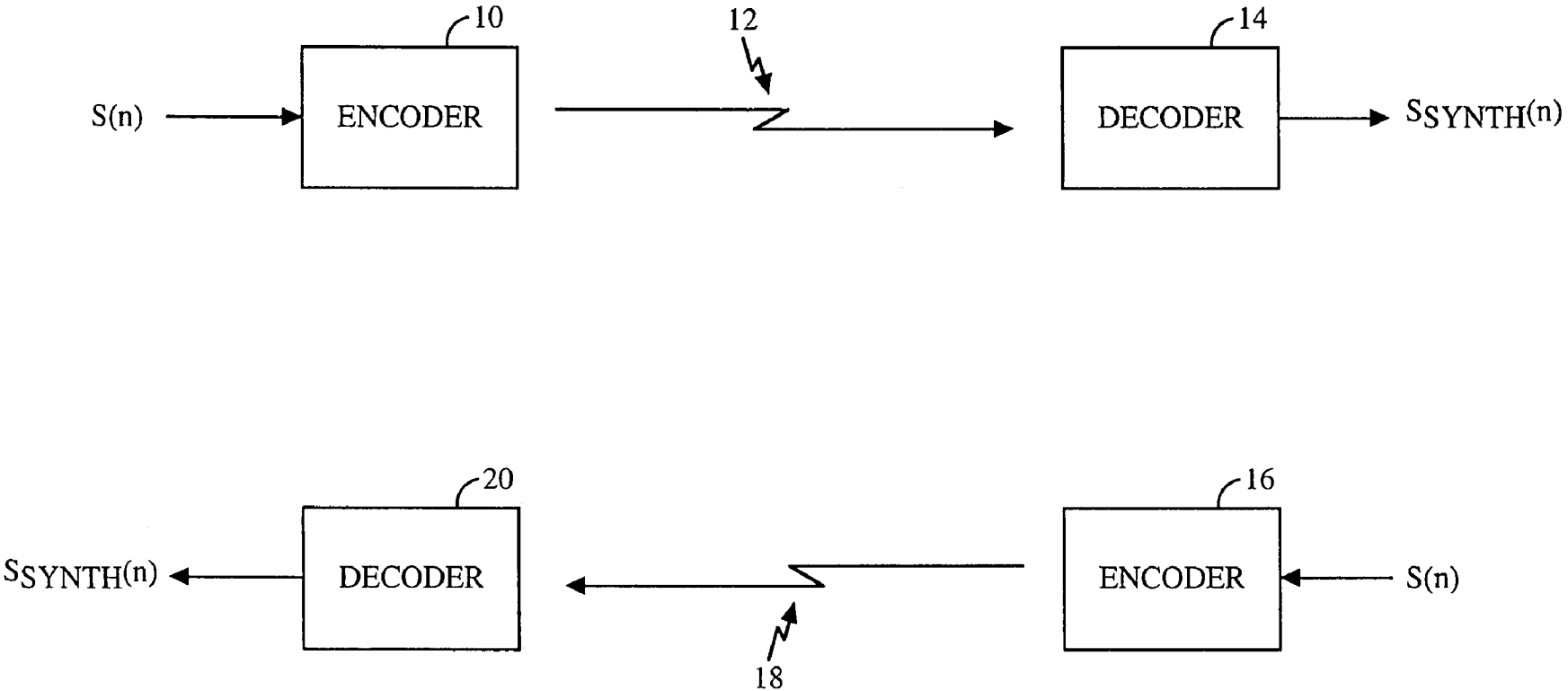
FIG. 1 is a block diagram of a communication channel terminated at each end by speech coders.

In FIG. 1 a first encoder 10 receives digitized speech samples s(n) and encodes the samples s(n) for transmission on a transmission medium 12, or communication channel 12, to a first decoder 14. The decoder 14 decodes the encoded speech samples and synthesizes an output speech signal $s_{SYNTH}(n)$. For transmission in the opposite direction, a second encoder 16 encodes digitized speech samples s(n), which are transmitted on a communication channel 18. A second decoder 20 receives and decodes the encoded speech samples, generating a synthesized output speech signal $s_{SYNTH}(n)$.

The speech samples, s(n), represent speech signals that have been digitized and quantized in accordance with any of various methods known in the art including, e.g., pulse code modulation (PCM), companded μ-law, or A-law. As known in the art, the speech samples, s(n), are organized into frames of input data wherein each frame comprises a predetermined number of digitized speech samples s(n). In an exemplary embodiment, a sampling rate of 8 kHz is employed, with each 20 ms frame comprising 160 samples. In the embodiments described below, the rate of data transmission may be varied on a frame-to-frame basis from 8 kbps (full rate) to 4 kbps (half rate) to 2 kbps (quarter rate) to 1 kbps (eighth rate). Alternatively, other data rates may be used. As used herein, the terms "full rate" or "high rate" generally refer to data rates that are greater than or equal to 8 kbps, and the terms "half rate" or "low rate" generally refer to data rates that are less than or equal to 4 kbps. Varying the data transmission rate is beneficial because lower bit rates may be selectively employed for frames containing relatively less speech information. As understood by those skilled in the art, other sampling rates, frame sizes, and data transmission rates may be used.

The first encoder 10 and the second decoder 20 together comprise a first speech coder, or speech codec. Similarly, the second encoder 16 and the first decoder 14 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the presently disclosed embodiments and fully incorporated herein by reference, and U.S. Pat. No. 5,784,532, entitled APPLICATION SPECIFIC INTEGRATED CIRCUIT (ASIC) FOR PERFORMING RAPID SPEECH COMPRESSION IN A MOBILE TELEPHONE SYSTEM, assigned to the assignee of the presently disclosed embodiments, and fully incorporated herein by reference.

Figure 2A:
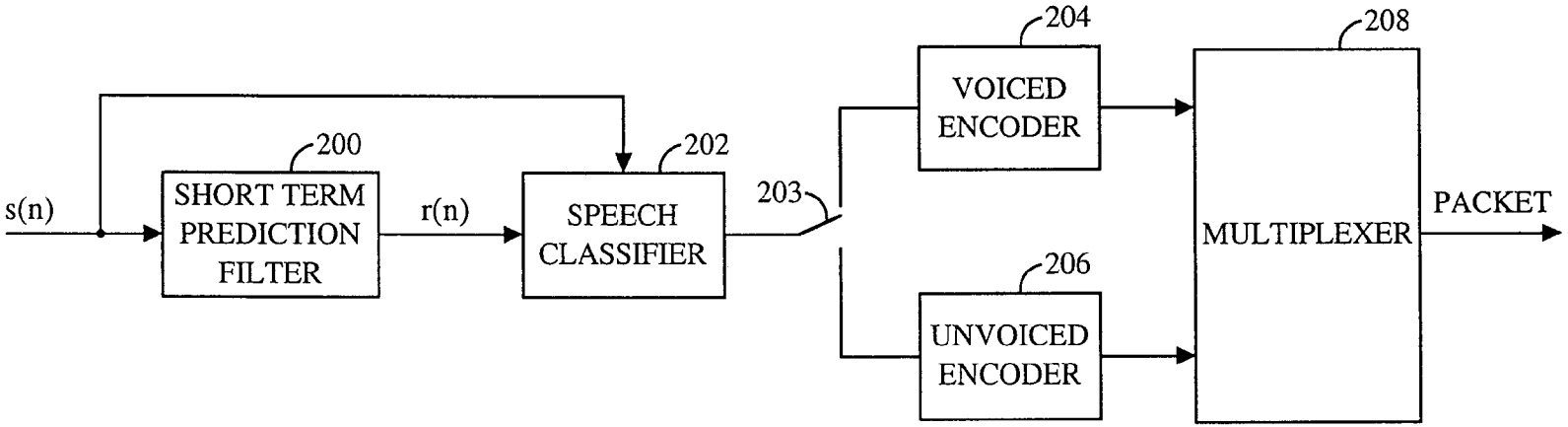
FIG. 2A is a block diagram of an encoder that can be used in a high performance low bit rate speech coder.

FIG. 2A is a block diagram of an encoder, illustrated in FIG. 1 (10, 16), that may employ the presently disclosed embodiments. A speech signal, s(n), is filtered by a short-term prediction filter 200. The speech itself, s(n), and/or the linear prediction residual signal r(n) at the output of the short-term prediction filter 200 provide input to a speech classifier 202.

The output of speech classifier 202 provides input to a switch 203 enabling the switch 203 to select a corresponding mode encoder (204,206) based on a classified mode of speech. One skilled in the art would understand that speech classifier 202 is not limited to voiced and unvoiced speech classification and may also classify transition, background noise (silence), or other types of speech.

Voiced speech encoder 204 encodes voiced speech by any conventional method such as e.g., CELP or Prototype Waveform Interpolation (PWI).

Unvoiced speech encoder 206 encodes unvoiced speech at a low bit rate in accordance with the embodiments described below. Unvoiced speech encoder 206 is described with reference to detail in FIG. 3 in accordance with one embodiment.

After encoding by either encoder 204 or encoder 206), multiplexer 208 forms a packet bit-stream comprising data packets, speech mode, and other encoded parameters for transmission.

Figure 2B:
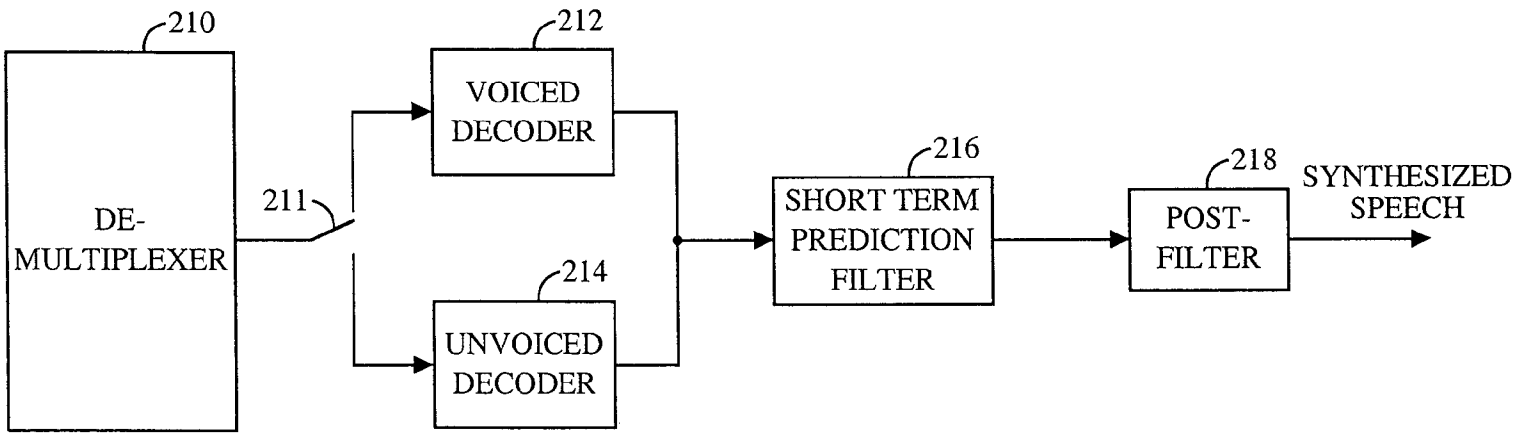
FIG. 2B is a block diagram of a decoder that can be used in a high performance low bit rate speech coder.

FIG. 2B is a block diagram of a decoder, illustrated in FIG. 1 (14, 20), that may employ the presently disclosed embodiments.

De-multiplexer 210 receives a packet bit-stream, de-multiplexes data from the bit stream, and recovers data packets, speech mode, and other encoded parameters.

The output of de-multiplexer 210 provides input to a switch 211 enabling the switch 211 to select a corresponding mode decoder (212, 214) based on a classified mode of speech. One skilled in the art would understand that switch 211 is not limited to voiced and unvoiced speech modes and may also recognize transition, background noise (silence), or other types of speech.

Voiced speech decoder 212 decodes voiced speech by performing the inverse operations of voiced encoder 204.

In one embodiment, unvoiced speech decoder 214 decodes unvoiced speech transmitted at a low bit rate as described below in detail with reference to FIG. 4.

After decoding by either decoder 212 or decoder 214, a synthesized linear prediction residual signal is filtered by a short-term prediction filter 216. The synthesized speech at the output of the short-term prediction filter 216 is passed to a post filter processor 218 to generate final output speech.

Figure 3:
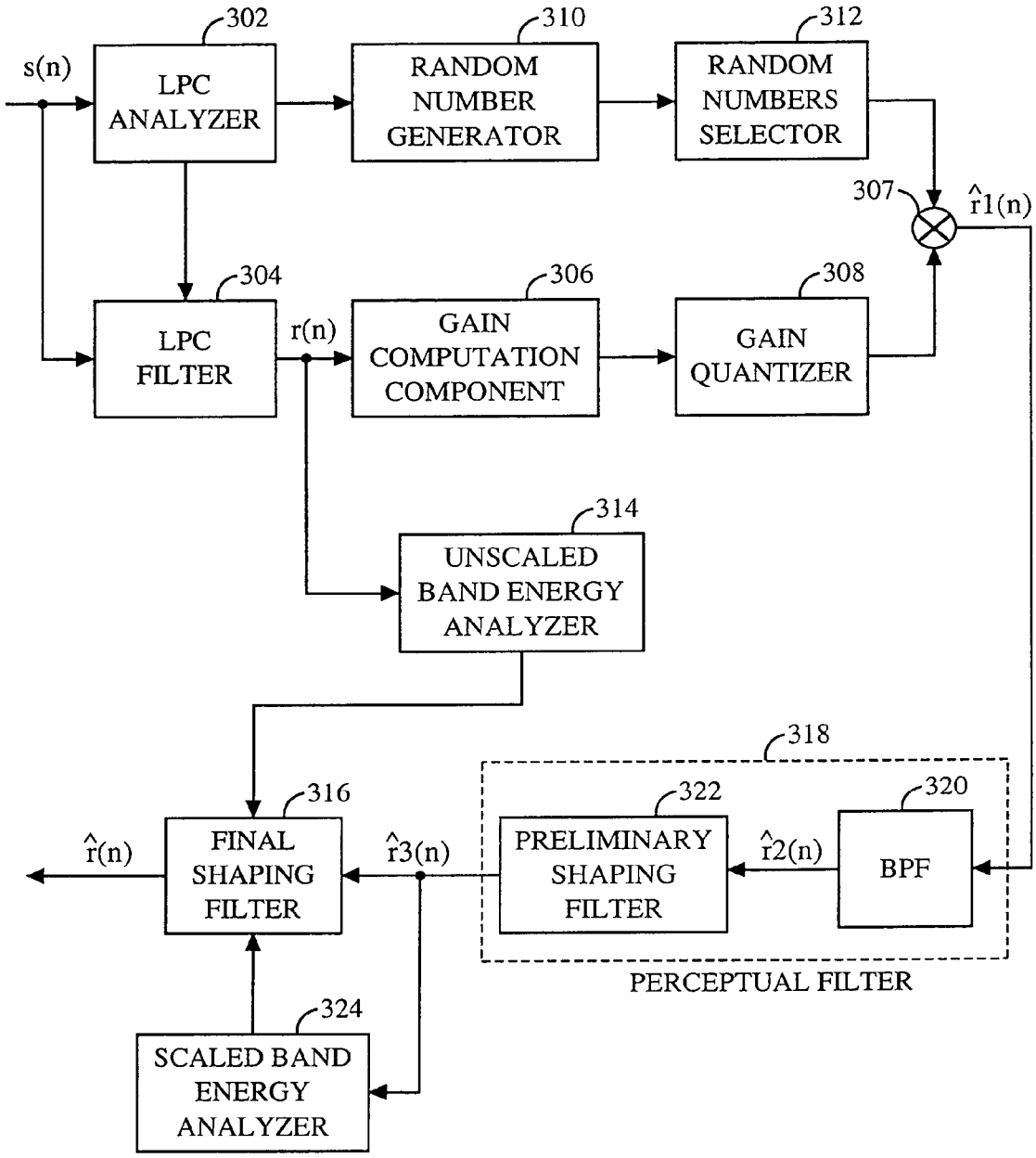
FIG. 3 illustrates a high performance low bit rate unvoiced speech encoder that could be used in the encoder of FIG. 2A.

FIG. 3 is a detailed block diagram of the high performance low bit rate unvoiced speech encoder 206 illustrated in FIG. 2A. FIG. 3 details the apparatus and sequence of operations of one embodiment of the unvoiced encoder.

Digitized speech samples, s(n), are input to Linear Predictive Coding (LPC) analyzer 302 and LPC filter 304. LPC analyzer 302 produces Linear Predictive (LP) coefficients of the digitized speech samples. LPC filter 304 produces a speech residual signal, r(n), that is input to Gain Computation component 306 and Unscaled Band Energy Analyzer 314.

Gain Computation component 306 divides each frame of digitized speech samples into sub-frames, computes a set of codebook gains, hereinafter referred to as gains or indices, for each sub-frame, divides the gains into sub-groups, and normalizes the gains of each sub-group. The speech residual signal r(n), n=0, . . . ,N−1, is segmented into K sub-frames, where N is the number of residual samples in a frame. In one embodiment, K=10 and N=160. A gain, G(i), i=0, . . . ,K−1, is computed for each sub-frame as follows:

$$G(i) = \sum_{k=0}^{N/K-1} r(i*N/K+k)^2,$$

$$i = 0, \ldots, K-1, \text{ and } G(i) = \sqrt{\frac{G(i)}{N/K}}.$$

Gain Quantizer 308 quantizes the K gains, and the gain codebook index for the gains is subsequently transmitted. Quantization can be performed using conventional linear or vector quantization schemes, or any variant. One embodied scheme is multi-stage vector quantization.

Figure 7A:
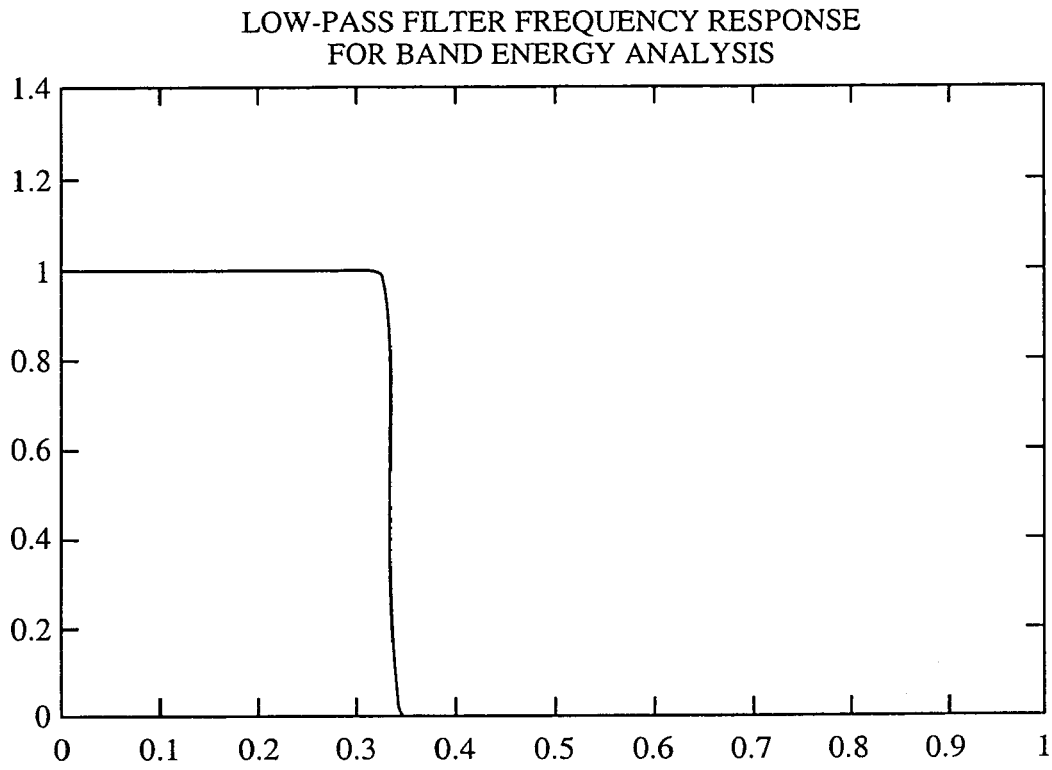
FIG. 7A is a graph of a frequency response of low pass filtering for use in band energy analysis.
Figure 7B:
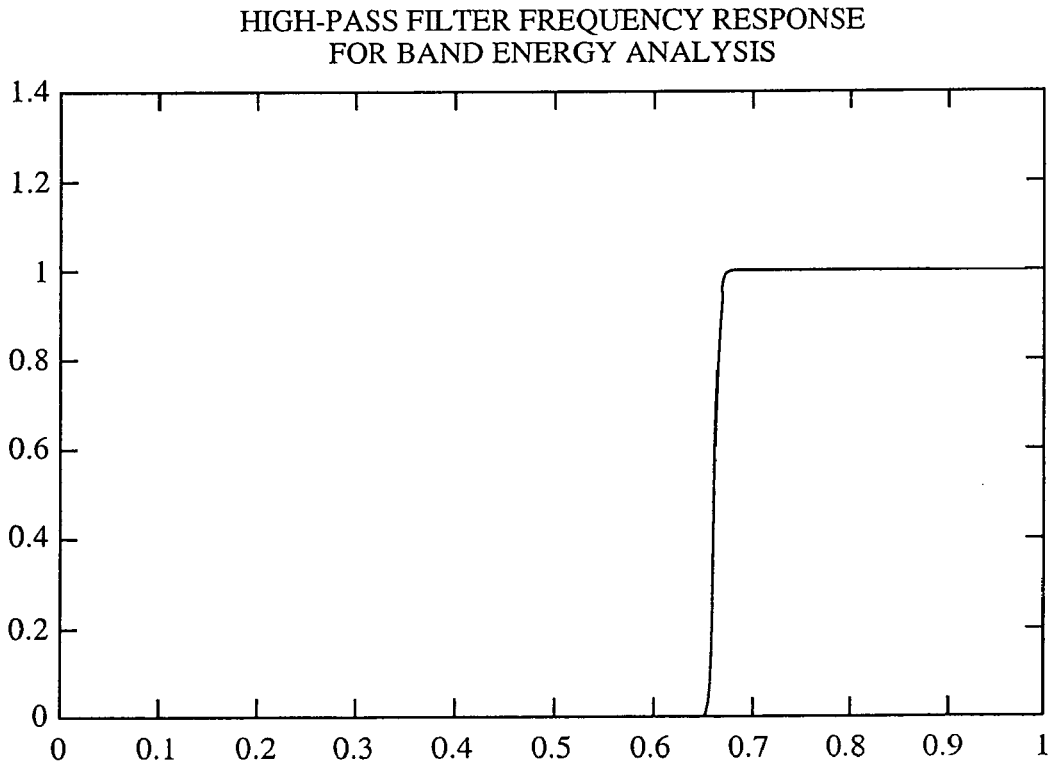
FIG. 7B is a graph of a frequency response of high pass filtering for use in band energy analysis.

The residual signal output from LPC filter 304, r(n), is passed through a low-pass filter and a high-pass filter in Unscaled Band Energy Analyzer 314. Energy values of r(n), $E_1$, $E_{lp1}$, and $E_{hp1}$, are computed for the residual signal, r(n). $E_1$ is the energy in the residual signal, r(n). $E_{lp1}$, is the low band energy in the residual signal, r(n). $E_{hp1}$ is the high band energy in the residual signal, r(n). The frequency response of the low pass and high pass filters of Unscaled Band Energy Analyzer 314, in one embodiment, are shown in FIG. 7A and FIG. 7B, respectively. Energy values $E_1$, $E_{lp1}$, and $E_{hp1}$ are computed as follows:

$$E_1 = \sum_{i=0}^{N-1} r^2(n),$$

$$r_{lp}(n) = \sum_{i=1}^{M_{lp}-1} r_{lp}(n-i)*a_{lp}(i) + \sum_{j=0}^{N_{lp}-1} r(n-j)*b_{lp}(j),$$

$$n = 0, \ldots, N-1,$$

$$r_{hp}(n) = \sum_{i=1}^{M_{hp}-1} r_{hp}(n-i)*a_{hp}(i) + \sum_{j=0}^{N_{hp}-1} r(n-j)*b_{hp}(j),$$

$$n = 0, \ldots, N-1,$$

$$E_{lp1} \sum_{i=0}^{N-1} r_{lp}^2(i), \text{ and } E_{hp1} = \sum_{i=0}^{N-1} r_{hp}^2(i).$$

Energy values $E_1$, $E_{lp1}$, and $E_{hp1}$ are later used to select shaping filters in Final Shaping Filter 316 for processing a random noise signal so that the random noise signal most closely resembles the original residual signal.

Random Number Generator 310 generates unity variance, uniformly distributed random numbers between −1 and 1 for each of the K sub-frames output by LPC analyzer 302. Random Numbers Selector 312 selects against a majority of the low amplitude random numbers in each sub-frame. A fraction of the highest amplitude random numbers are retained for each sub-frame. In one embodiment, the fraction of random numbers retained is 25%.

The random number output for each sub-frame from Random Numbers Selector 312 is then multiplied by the respective quantized gains of the sub-frame, output from Gain Quantizer 308, by multiplier 307. The scaled random signal output of multiplier 307, $\hat{r}_1(n)$, is then processed by perceptual filtering.

Figure 8A:
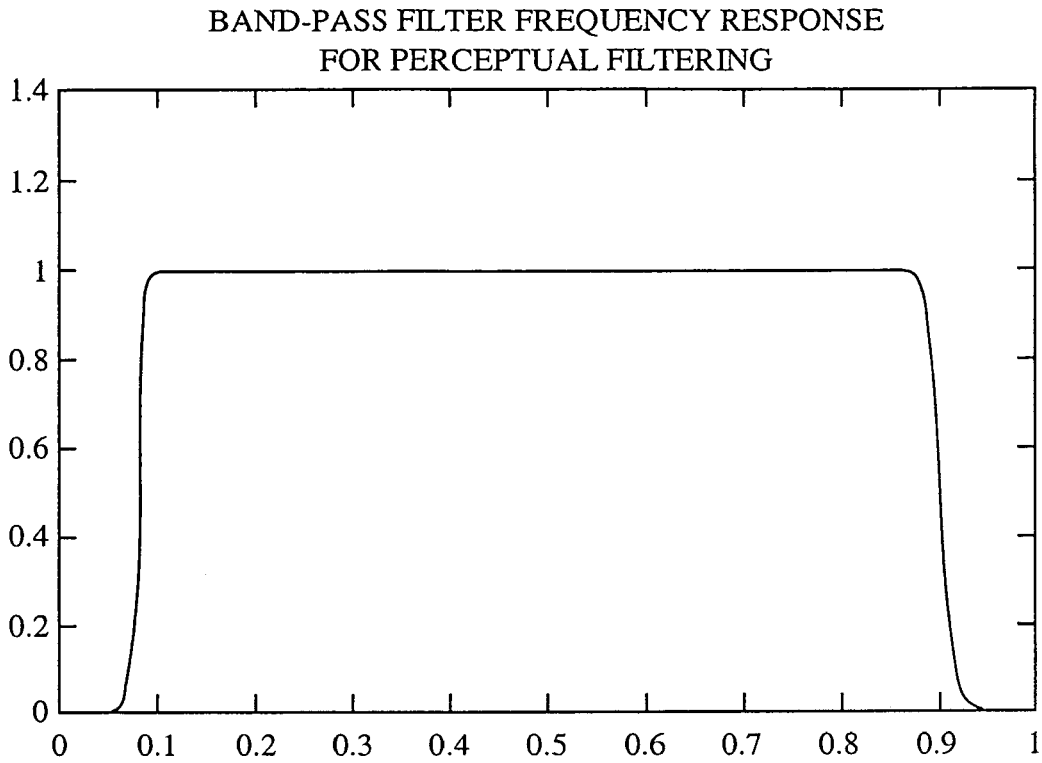
FIG. 8A is a graph of a frequency response of a band pass filter for use in perceptual filtering.
Figure 8B:
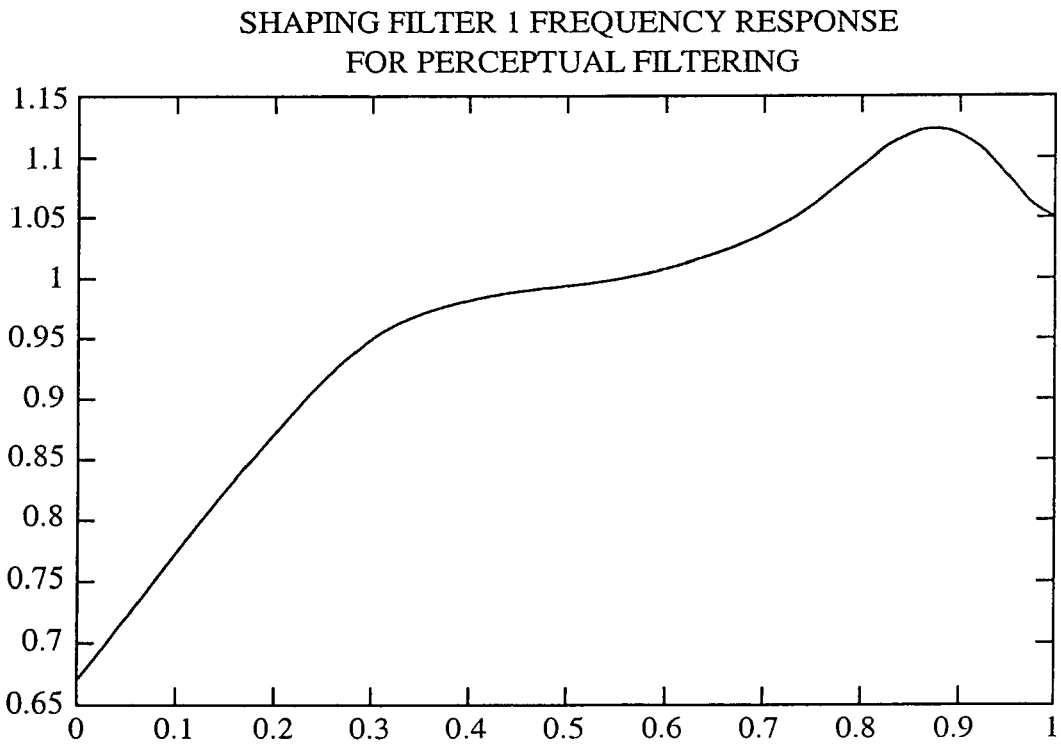
FIG. 8B is a graph of a frequency response of a preliminary shaping filter for use in perceptual filtering.

To enhance perceptual quality and maintain the naturalness of the quantized unvoiced speech, a two-step perceptual filtering process is performed on the scaled random signal, $\hat{r}_1(n)$ In the first step of the perceptual filtering process, scaled random signal $\hat{r}_1(n)$ is passed through two fixed filters in Perceptual Filter 318. The first fixed filter of Perceptual Filter 318 is a band pass filter 320 that eliminates low-end and high-end frequencies from $\hat{r}_1(n)$ to produce the signal, $\hat{r}_2(n)$. The frequency response of band pass filter 320, in one embodiment, is illustrated in FIG. 8A. The second fixed filter of Perceptual Filter 318 is Preliminary Shaping Filter 322. The signal, $\hat{r}_2(n)$, computed by element 320, is passed through Preliminary Shaping Filter 322 to produce the signal $\hat{r}_3(n)$. The frequency response of Preliminary Shaping Filter 322, in one embodiment, is illustrated in FIG. 8B.

The signals $\hat{r}_2(n)$, computed by element 320, and $\hat{r}_3(n)$, computed by element 322, are computed as follows:

$$\hat{r}_2(n) = \sum_{i=1}^{M_{bp}-1} \hat{r}_2(n-i) * a_{bp}(i) + \sum_{j=0}^{N_{bp}-1} \hat{r}_1(n-j) * b_{bp}(j),$$

$$n = 0, \ldots, N-1, \text{ and}$$

$$\hat{r}_3(n) = \sum_{i=1}^{M_{sp1}-1} \hat{r}_3(n-i) * a_{sp1}(i) + \sum_{j=0}^{N_{sp1}-1} \hat{r}_2(n-j) * b_{sp1}(j),$$

$$n = 0, \ldots, N-1.$$

The energy of signals $\hat{r}_2(n)$ and $\hat{r}_3(n)$ are computed as $E_2$ and $E_3$ respectively. $E_2$ and $E_3$ are computed as follows:

$$E_2 = \sum_{i=0}^{N-1} \hat{r}_2^2(n), \text{ and } E_3 = \sum_{i=0}^{N-1} \hat{r}_3^2(n).$$

In the second step of the perceptual filtering process, the signal $\hat{r}_3(n)$, output from Preliminary Shaping Filter 322, is scaled to have the same energy as the original residual signal r(n), output from LPC filter 304, based on $E_1$ and $E_3$.

In Scaled Band Energy Analyzer 324, the scaled and filtered random signal, $\hat{r}_3(n)$ computed by element (322), is subjected to the same band energy analysis previously performed on the original residual signal, r(n), by Unscaled Band Energy Analyzer 314.

The signal, $\hat{r}_3(n)$, computed by element 322, is computed as follows:

$$\hat{r}_3(n) = \sqrt{\frac{E_1}{E_3}}\,\hat{r}_3(n),\ n = 0, \ldots, N-1.$$

The low pass band energy of $\hat{r}_3(n)$ is denoted as $E_{lp2}$, and the high pass band energy of $\hat{r}_3(n)$ is denoted as $E_{hp2}$. The high band and low band energies of $\hat{r}_3(n)$ are compared with the high band and low band energies of r(n) to determine the next shaping filter to use in Final Shaping Filter 316. Based on the comparison of r(n) and $\hat{r}_3(n)$, either no further filtering, or one of two fixed shaping filters is chosen to produce the closest match between r(n) and $\hat{r}_3(n)$. The final filter shape (or no additional filtering) is determined by comparing the band energy in the original signal with the band energy in the random signal.

The ratio, $R_l$, of the low band energy of the original signal to the low band energy of the scaled pre-filtered random signal is calculated as follows:

$$R_l = 10 * \log_{10}(E_{lp1}/E_{lp2}).$$

The ratio, $R_h$, of the high band energy of the original signal to the high band energy of the scaled pre-filtered random signal is calculated as follows:

$$R_h = 10 * \log_{10}(E_{hp1}/E_{hp2}).$$

If the ratio $R_l$ is less than −3, a high pass final shaping filter (filter 2) is used to further process $\hat{r}_3(n)$ to produce $\hat{r}(n)$.

If the ratio $R_h$ is less than −3, a low pass final shaping filter (filter3) is used to further process $\hat{r}_3(n)$ to produce $\hat{r}(n)$.

Otherwise, no further processing of $\hat{r}_3(n)$ is performed, so that $\hat{r}(n) = \hat{r}_3(n)$.

The output from Final Shaping Filter 316 is the quantized random residual signal $\hat{r}(n)$. The signal $\hat{r}(n)$ is scaled to have the same energy as $\hat{r}_2(n)$.

Figure 8C:
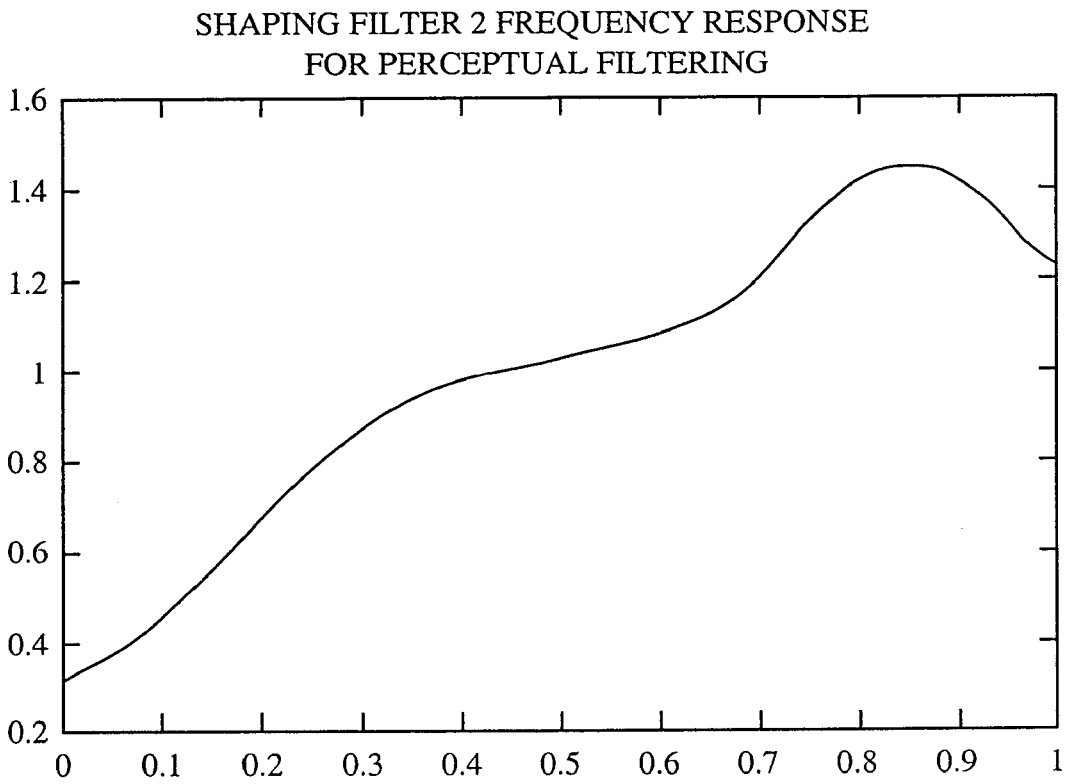
FIG. 8C is a graph of a frequency response of one shaping filter that may used in final perceptual filtering.
Figure 8D:
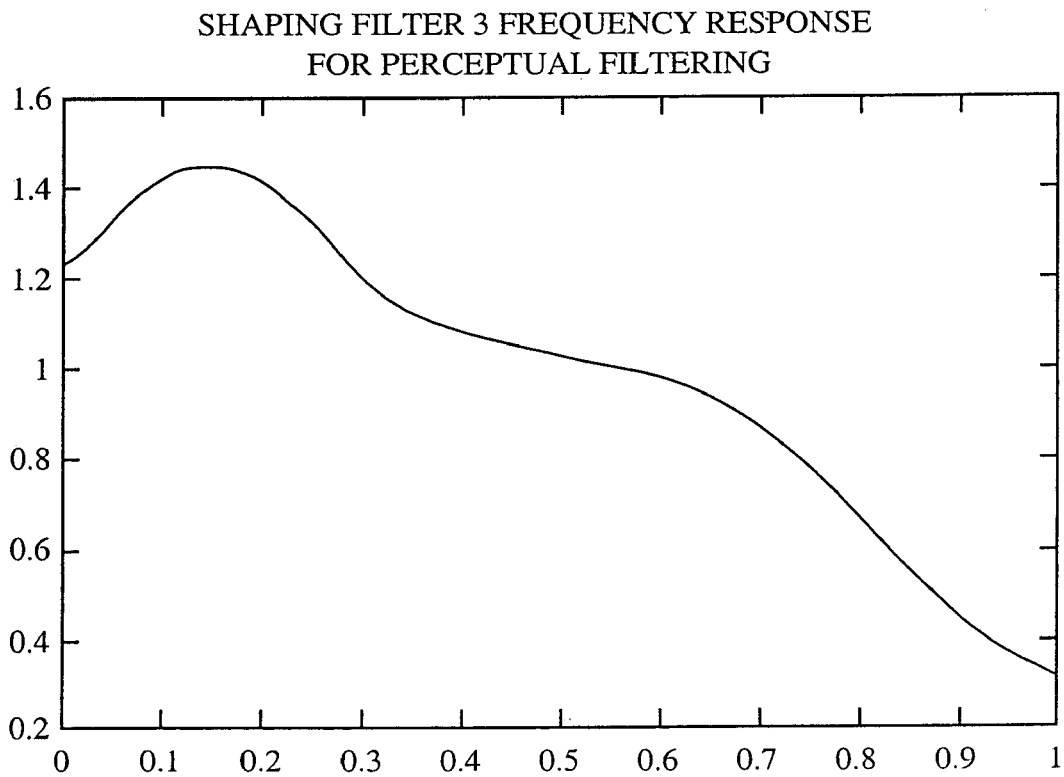
FIG. 8D is a graph of a frequency response of a another shaping filter that may be used in final perceptual filtering.

The frequency response of high pass final shaping filter (filter 2) is shown in FIG. 8C. The frequency response of low pass final shaping filter (filter 3) is shown in FIG. 8D.

A filter selection indicator is generated to indicate which filter (filter2, filter 3, or no filter) was selected for final filtering. The filter selection indicator is subsequently transmitted so that a decoder can replicate final filtering. In one embodiment, the filter selection indicator consists of two bits.

Figure 4:
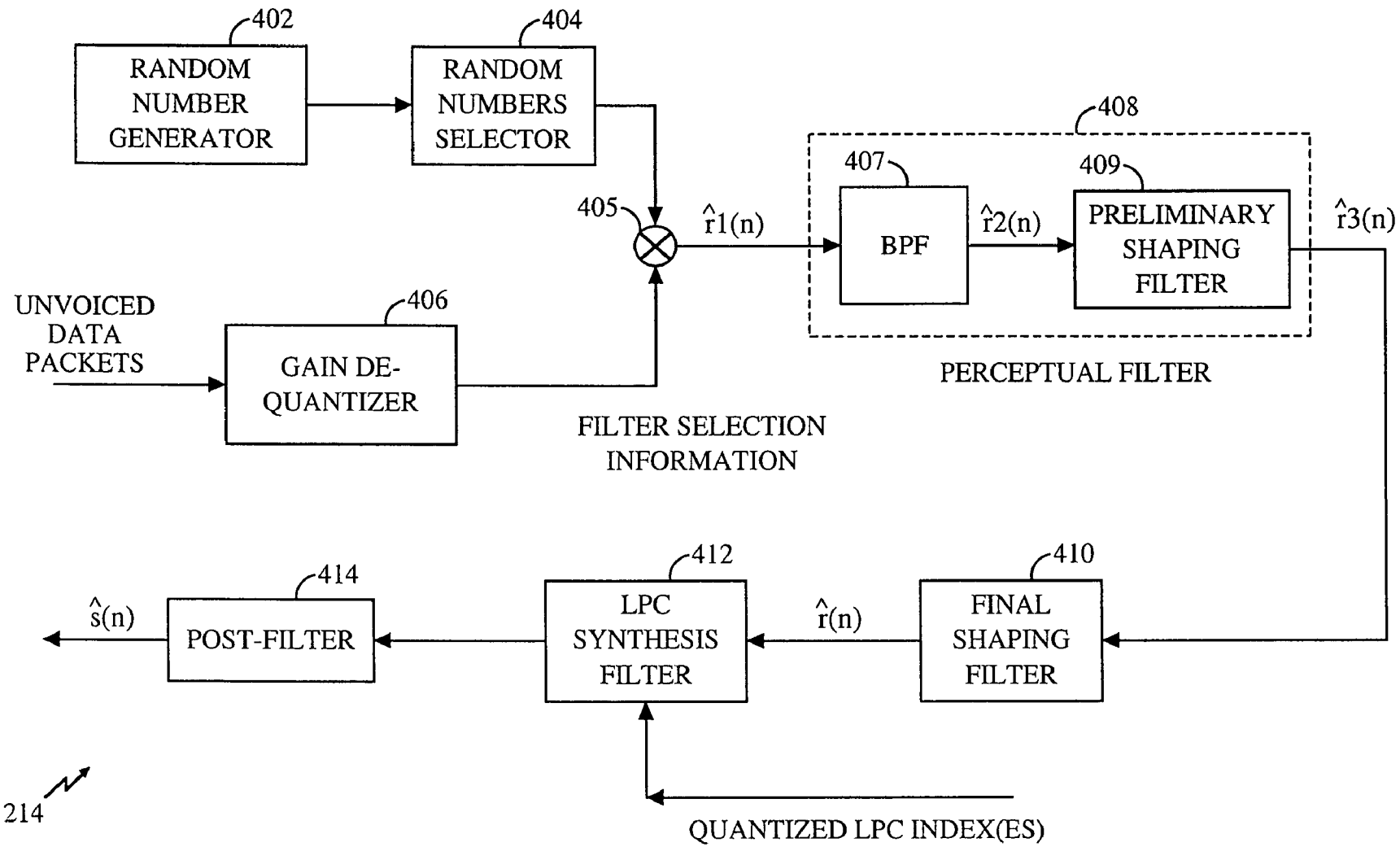
FIG. 4 illustrates a high performance low bit rate unvoiced speech decoder that could be used in the decoder of FIG. 2B.

FIG. 4 is a detailed block diagram of the high performance low bit rate unvoiced speech decoder 214 illustrated in FIG. 2B. FIG. 4 details the apparatus and sequence of operations of one embodiment of the unvoiced speech decoder. The unvoiced speech decoder receives unvoiced data packets and synthesizes unvoiced speech from the data packets by performing the inverse operations of the unvoiced speech encoder 206 illustrated in FIG. 2A.

Unvoiced data packets are input to Gain De-quantizer 406. Gain De-quantizer 406 performs the inverse operation of gain quantizer 308 in the unvoiced encoder illustrated in FIG. 3. The output of Gain De-quantizer 406 is K quantized unvoiced gains.

Random Number Generator 402 and Random Numbers Selector 404 perform exactly the same operations as Random Number Generator 310 and Random Numbers Selector 312, in the unvoiced encoder of FIG. 3.

The random number output for each sub-frame from Random Numbers Selector 404 is then multiplied by the respective quantized gain of the sub-frame, output from Gain De-quantizer 406, by multiplier 405. The scaled random signal output of multiplier 405, $\hat{r}_1(n)$, is then processed by perceptual filtering.

A two-step perceptual filtering process identical to the perceptual filtering process of the unvoiced encoder in FIG. 3 is performed. Perceptual Filter 408 performs exactly the same operations as Perceptual Filter 318 in the unvoiced encoder of FIG. 3. Random signal $\hat{r}_1(n)$ is passed through two fixed filters in Perceptual Filter 408. The Band Pass Filter 407 and Preliminary Shaping Filter 409 are exactly the same as the Band Pass Filter 320 and Preliminary Shaping Filter 322 used in the Perceptual Filter 318 in the unvoiced encoder of FIG. 3. The outputs after Band Pass Filter 407 and Preliminary Shaping Filter 409 are denoted as $\hat{r}_2(n)$ and $\hat{r}_3(n)$, respectively. Signals $\hat{r}_2(n)$ and $\hat{r}_3(n)$ are calculated as in the unvoiced encoder of FIG. 3.

Signal $\hat{r}_3(n)$ is filtered in Final Shaping Filter 410. Final Shaping Filter 410 is identical to Final Shaping Filter 316 in the unvoiced encoder of FIG. 3. Either high pass final shaping, low pass final shaping, or no further final filtering is performed by Final Shaping Filter 410, as determined by the filter selection indicator generated at the unvoiced encoder of FIG. 3 and received in the data bit packet at the decoder 214. The output quantized residual signal, $\hat{r}(n)$, from Final Shaping Filter 410 is scaled to have the same energy as $\hat{r}_2(n)$.

The quantized random signal, $\hat{r}(n)$, is filtered by LPC synthesis filter 412 to generate synthesized speech signal, $\hat{s}(n)$.

A subsequent Post-filter 414 could be applied to the synthesized speech signal, $\hat{s}(n)$, to generate the final output speech.

Figure 5:
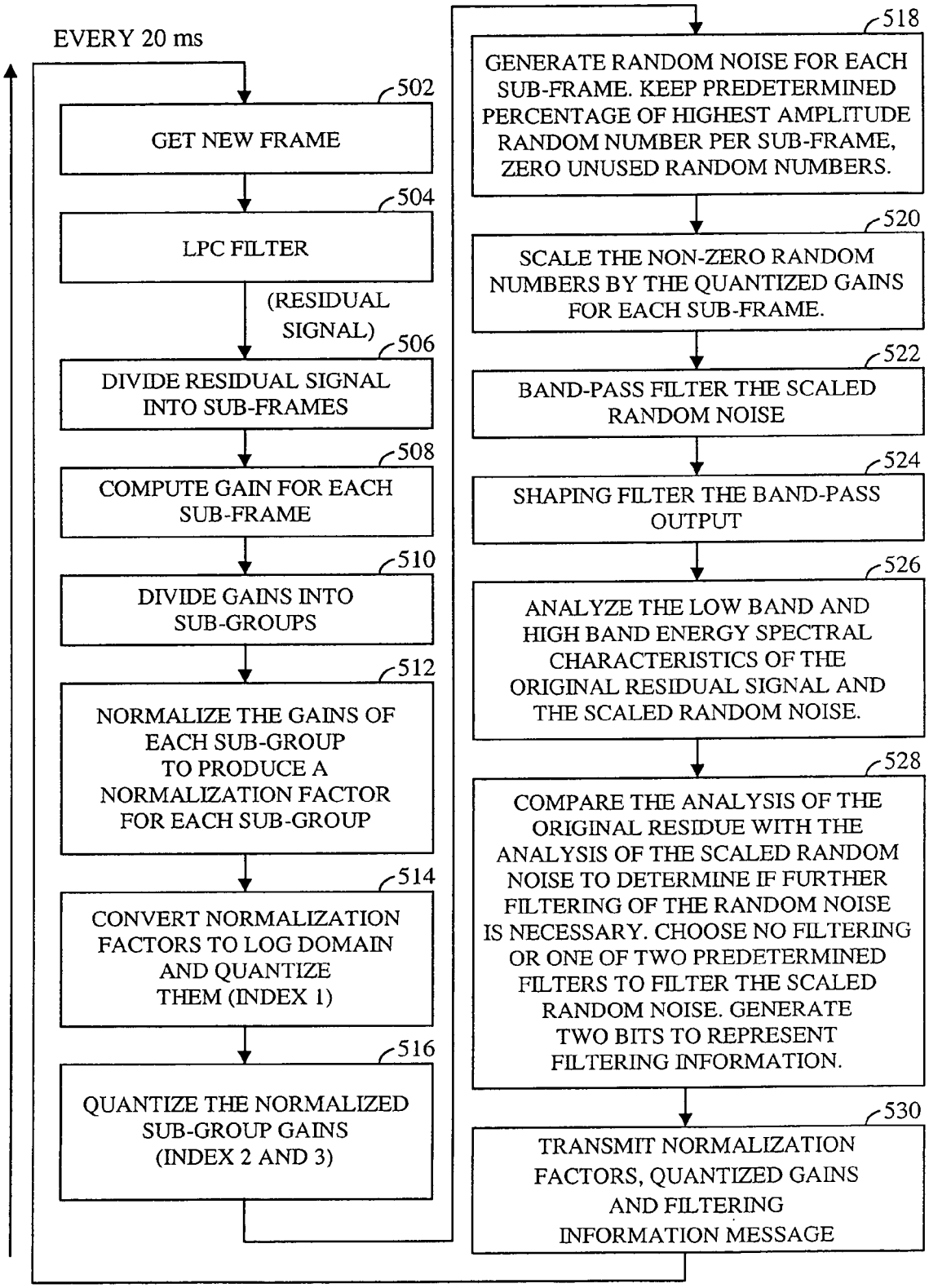
FIG. 5 is a flow chart illustrating encoding steps of a high performance low bit rate coding technique for unvoiced speech.

FIG. 5 is a flow chart illustrating the encoding steps of a high performance low bit rate coding technique for unvoiced speech.

In step 502, an unvoiced speech encoder 206 is provided a data frame of unvoiced digitized speech samples. A new frame is provided every 20 milliseconds. In one embodiment, where the unvoiced speech is sampled at a rate of 8 kilobits per second, a frame contains 160 samples. Control flow proceeds to step 504.

In step 504, the data frame is filtered by an LPC filter, producing a residual signal frame. Control flow proceeds to step 506.

Steps 506–516 describe method steps for gain computation and quantization of a residual signal frame.

The residual signal frame is divided into sub-frames in step 506. In one embodiment, each frame is divided into ten sub-frames of sixteen samples each. Control flow proceeds to step 508.

In step 508, a gain is computed for each sub-frame. In one embodiment ten sub-frame gains are computed. Control flow proceeds to step 510.

In step 510, sub-frame gains are divided into sub-groups. In one embodiment, 10 sub-frame gains are divided into two sub-groups of five sub-frame gains each. Control flow proceeds to step 512.

In step 512, the gains of each subgroup are normalized, to produce a normalization factor for each sub-group. In one embodiment, two normalization factors are produced for two sub-groups of five gains each. Control flow proceeds to step 514.

In step 514, the normalization factors produced in step 512 are converted to the log domain, or exponential form, and then quantized. In one embodiment, a quantized normalization factor is produced, herein after referred to as Index 1. Control flow proceeds to step 516.

In step 516, the normalized gains of each sub-group produced in step 512 are quantized. In one embodiment, two sub-groups are quantized to produce two quantized gain values, herein after referred to as Index 2 and Index 3. Control flow proceeds to step 518.

Steps 518–520 describe the method steps for generating a random quantized unvoiced speech signal.

In step 518, a random noise signal is generated for each sub-frame. A predetermined percentage of the highest amplitude random numbers generated are selected per sub-frame. The unselected numbers are zeroed. In one embodiment, the percentage of random numbers selected is 25%. Control flow proceeds to step 520.

In step 520, the selected random numbers are scaled by the quantized gains for each sub-frame produced in step 516. Control flow proceeds to step 522.

Steps 522–528 describe methods steps for perceptual filtering of the random signal. The Perceptual Filtering of steps 522–528 enhances perceptual quality and maintains the naturalness of the random quantized unvoiced speech signal.

In step 522, the random quantized unvoiced speech signal is band pass filtered to eliminate high and low end components. Control flow proceeds to step 524.

In step 524, a fixed preliminary shaping filter is applied to the random quantized unvoiced speech signal. Control flow proceeds to step 526.

In step 526, the low and high band energies of the random signal and the original residual signal are analyzed. Control flow proceeds to step 528.

In step 528, the energy analysis of the original residual signal is compared to the energy analysis of the random signal, to determine if further filtering of the random signal is necessary. Based on the analysis, either no filter, or one of two pre-determined final filters is selected to further filter the random signal. The two pre-determined final filters are a high pass final shaping filter and a low pass final shaping filter. A filter selection indication message is generated to indicated to a decoder which final filter (or no filter) was applied. In one embodiment, the filter selection indication message is 2 bits. Control flow proceeds to step 530.

In step 530, an index for the quantized normalization factor produced in step 514, indexes for the quantized sub-group gains produced in step 516, and the filter selection indication message generated in step 528 are transmitted. In one embodiment, Index 1, Index 2, Index 3, and a 2 bit final filter selection indication is transmitted. Including the bits required to transmit the quantized LPC parameter indices, the bit rate of one embodiment is 2 Kilobits per second. (Quantization of LPC parameters is not within the scope of the disclosed embodiments.)

Figure 6:
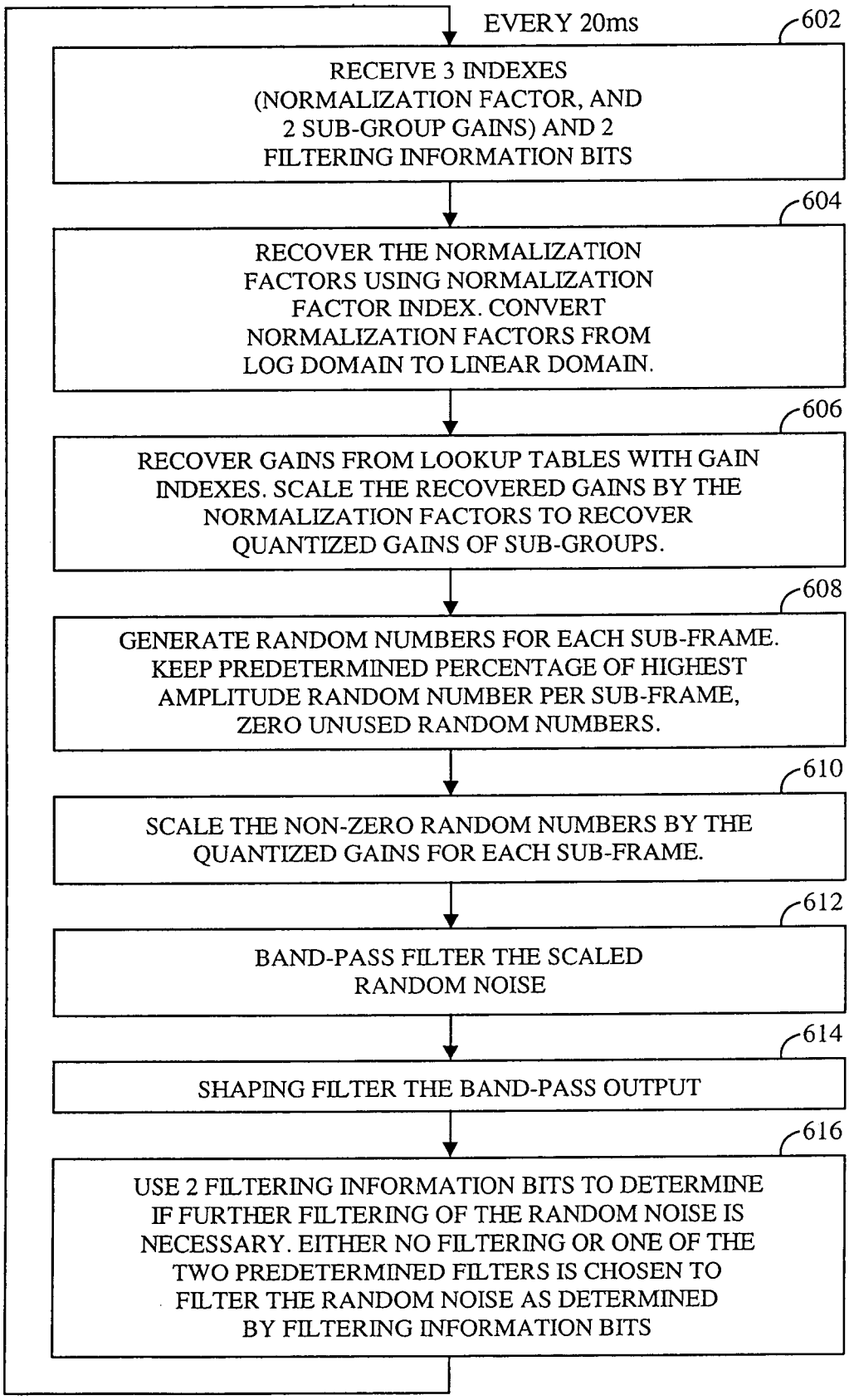
FIG. 6 is a flow chart illustrating decoding steps of a high performance low bit rate coding technique for unvoiced speech.

FIG. 6 is a flow chart illustrating the decoding steps of a high performance low bit rate coding technique for unvoiced speech.

In step 602, a normalization factor index, quantized sub-group gain indexes, and a final filter selection indicator are received for a frame of unvoiced speech. In one embodiment, Index 1, Index 2, Index 3, and a 2 bit filter selection indication is received. Control flow proceeds to step 604.

In step 604, the normalization factor is recovered from look-up tables using the normalization factor index. The normalization factor is converted from the log domain, or exponential form, to the linear domain. Control flow proceeds to step 606.

In step 606, the gains are recovered from look-up tables using the gain indexes. The recovered gains are scaled by the recovered normalization factors to recover the quantized gains of each sub-group of the original frame. Control flow proceeds to step 608.

In step 608, a random noise signal is generated for each sub-frame, exactly as in encoding. A predetermined percentage of the highest amplitude random numbers generated are selected per sub-frame. The unselected numbers are zeroed. In one embodiment, the percentage of random numbers selected is 25%. Control flow proceeds to step 610.

In step 610, the selected random numbers are scaled by the quantized gains for each sub-frame recovered in step 606.

Steps 612–616 describe decoding method steps for perceptual filtering of the random signal.

In steps 612, the random quantized unvoiced speech signal is band pass filtered to eliminate high and low end components. The band pass filter is identical to the band pass filter used in encoding. Control flow proceeds to step 614.

In step 614, a fixed preliminary shaping filter is applied to the random quantized unvoiced speech signal. The fixed preliminary shaping filter is identical to the fixed preliminary shaping filter used in encoding. Control flow proceeds to step 616.

In step 616, based on the filter selection indication message, either no filter, or one of two pre-determined filters is selected to further filter the random signal in a final shaping filter. The two pre-determined filters of the final shaping filter are a high pass final shaping filter (filter 2) and a low pass final shaping filter (filter 3) identical to the high pass final shaping filter and low pass final shaping filter of the encoder. The output quantized random signal from the Final Shaping Filter is scaled to have the same energy as the signal output of the band pass filter. The quantized random signal is filtered by an LPC synthesis filter to generate a synthesized speech signal. A subsequent Post-filter may be applied to the synthesized speech signal to generate the final decoded output speech.

FIG. 7A is a graph of the normalized frequency versus amplitude frequency response of a low pass filter in the Band Energy Analyzers (314,324) used to analyze low band energy in the residual signal r(n), output from the LPC filter (304) in the encoder, and in the scaled and filtered random signal, $\hat{r}_3(n)$, output from the preliminary shaping filter (322) in the encoder.

FIG. 7B is a graph of the normalized frequency versus amplitude frequency response of a high pass filter in the Band Energy Analyzers (314,324) used to analyze high band energy in the residual signal r(n), output from the LPC filter (304) in the encoder, and in the scaled and filtered random signal, $\hat{r}_3(n)$, output from the preliminary shaping filter (322) in the encoder.

FIG. 8A is a graph of the normalized frequency versus amplitude frequency response of a low band pass final shaping filter in Band Pass Filter (320,407) used to shape the scaled random signal, $\hat{r}_1(n)$, output from the multiplier (307,405) in the encoder and the decoder.

FIG. 8B is a graph of the normalized frequency versus amplitude frequency response of a high band pass shaping filter in Preliminary Shaping Filter (322,409) used to shape the scaled random signal, $\hat{r}_2(n)$, output from the Band Pass Filter (320, 407) in the encoder and the decoder.

FIG. 8C is a graph of the normalized frequency versus amplitude frequency response of a high pass final shaping filter, in the final shaping filter (316, 410), used to shape scaled and filtered random signal, $\hat{r}_3(n)$, output from the preliminary shaping filter (322,409) in the encoder and decoder.

FIG. 8D is a graph of the normalized frequency versus amplitude frequency response of a low pass final shaping filter, in the final shaping filter (316, 410), used to shape scaled and filtered random signal, $\hat{r}_3(n)$, output from the preliminary shaping filter (322,409) in the encoder and decoder.

The previous description of the preferred embodiments is provided to enable any person skilled in the art to make or use the disclosed embodiments. The various modifications to these embodiments will be readily apparent to those skilled in the art, and the generic principles defined herein may be applied to other embodiments without the use of the inventive faculty. Thus, the disclosed embodiments are not intended to be limited to the embodiments shown herein but is to be accorded the widest scope consistent with the principles and novel features disclosed herein.

I claim:

1. A method of encoding unvoiced segments of speech, comprising:

partitioning a residual signal frame into sub-frames, each sub-frame having a codebook gain associated therewith;

quantizing the gains to produce indices;

scaling a percentage of random noise associated with each sub-frame by the indices associated with the sub-frame;

performing a first filtering of the scaled random noise;

computing the energy of the filtered scaled random noise and the energy of the residual signal;

comparing the energy of the filtered scaled random noise with the energy of the residual signal;

selecting a second filter based on the comparison; and performing a second filtering of the filtered scaled random noise using the selected second filter.

2. The method of claim 1, wherein the partitioning a residual signal frame into sub-frames comprises partitioning a residual signal frame into ten sub-frames.

3. The method of claim 1, wherein the residual signal frame comprises 160 samples per frame sampled at eight kilohertz per second for 20 milliseconds.

4. The method of claim 1, wherein the percentage of random noise is twenty-five percent.

5. The method of claim 1, wherein quantizing the gains to produce indices is performed using multi-stage vector quantization.

6. A speech coder for encoding unvoiced segments of speech, comprising:

means for partitioning a residual signal frame into sub-frames, each sub-frame having a codebook gain associated therewith;

means for quantizing the gains to produce indices;

means for scaling a percentage of random noise associated with each sub-frame by the indices associated with the sub-frame;

means for performing a first filtering of the scaled random noise;

means for computing the energy of the filtered, scaled random noise and the energy of the residual signal;

means for comparing the energy of the filtered noise with the energy of the residual signal;

means for selecting a secondary filter based on the comparison; and means for performing a secondary filtering of the filtered, scaled random noise in accordance with the selected filter.

7. The speech coder of claim 6, wherein the means for partitioning a residual signal frame into sub-frames comprises means for partitioning a residual signal frame into ten sub-frames.

8. The speech coder of claim 6, wherein the means for scaling a percentage of random noise comprises a means for scaling twenty-five percent of the highest-amplitude random noise.

9. The speech coder of claim 6, wherein the means for quantizing the gains to produce indices comprises means for multi-stage vector quantization.

10. A speech coder for encoding unvoiced segments of speech, comprising:

a gain computation component configured to partition a residual signal frame into sub-frames, each sub-frame having a codebook gain associated therewith;

a gain quantizer configured to quantize the gains to produce indices;

a random number selector and multiplier configured to scale a percentage of random noise associated with each sub-frame by the indices associated with the sub-frame;

a first perceptual filter configured to perform a first filtering of the scaled random noise;

a band energy analyzer configured to compare the filtered noise with the residual signal;

a plurality of second shaping filters configured to perform a second filtering of the random noise, wherein only one or none of the plurality of second shaping filters is selected to perform the second filtering in accordance with the comparison from the band energy analyzer.

11. A method of decoding unvoiced segments of speech, comprising:

recovering a group of quantized gains using received indices for a plurality of sub-frames;

generating a random noise signal comprising random numbers for each of the plurality of sub-frames;

selecting a pre-determined percentage of the highest-amplitude random numbers of the random noise signal for each of the plurality of sub-frames;

scaling the selected highest-amplitude random numbers by the recovered gains for each sub-frame to produce a scaled random noise signal;

band-pass filtering and shaping the scaled random noise signal; and selecting a second filter based on a received filter selection indicator and further shaping the scaled random noise signal with the selected filter.

12. The method of claim 11, further comprising further filtering the scaled random noise.

13. The method of claim 11, wherein the plurality of sub-frames comprise partitions of ten sub-frames per frame of encoded unvoiced speech.

14. The method of claim 11, wherein the plurality of sub-frames comprise partitions of sub-frame gains partitioned into sub-groups.

15. The method of claim 14, wherein the sub-groups comprise partitioning a group of ten sub-frame gains into two groups of five sub-frame gains each.

16. The method of claim 13, wherein the frame of encoded unvoiced speech comprises 160 samples per frame sampled at eight kilohertz per second for 20 milliseconds.

17. The method of claim 11, wherein the pre-determined percentage of the highest-amplitude random numbers is twenty-five percent.

18. The method of claim 14, wherein two normalization factors are recovered for two sub-groups of five sub-frame gains each.

19. A method of decoding unvoiced segments of speech, comprising:

recovering quantized gains partitioned into sub-frame gains from received indices associated with each sub-frame;

scaling a percentage of random noise associated with each sub-frame by the indices associated with the sub-frame;

performing a first filtering of the scaled random noise;

selecting a second filter from a plurality of filters in accordance with a received filter selection indicator; and performing a second filtering of the random noise using the selected second filter.

20. The method of claim 19, comprising further filtering the scaled random noise.

21. The method of claim 19, wherein the sub-frame gains comprise partitions of ten sub-frame gains per frame of encoded unvoiced speech.

22. The method of claim 21, wherein the frame of encoded unvoiced speech comprises 160 samples per frame sampled at eight kilohertz per second for 20 milliseconds.

23. The method of claim 19, wherein the percentage of random noise is twenty-five percent.

24. The method of claim 19, wherein the recovered quantized gains are quantized by multi-stage vector quantization.

25. A decoder for decoding unvoiced segments of speech, comprising:

means for recovering a group of quantized gains using received indices for a plurality of sub-frames;

means for generating a random noise signal comprising random numbers for each of the plurality of sub-frames;

means for selecting a pre-determined percentage of the highest-amplitude random numbers of the random noise signal for each of the plurality of sub-frames;

means for scaling the selected highest-amplitude random numbers by the recovered gains for each sub-frame to produce a scaled random noise signal;

means for band-pass filtering and shaping the scaled random noise signal; and means for selecting a second filter based on a received filter selection indicator and further shaping the scaled random noise signal with the selected filter.

26. The decoder of claim 25, comprising means for further filtering the scaled random noise.

27. The decoder of claim 25, wherein the means for selecting a pre-determined percentage of the highest-amplitude random numbers of the random noise signal further comprises means for selecting twenty five percent of the highest-amplitude random numbers.

28. A decoder for decoding unvoiced segments of speech, comprising:

a gain de-quantizer configured to recover a group of quantized gains using received indices for a plurality of sub-frames;

a random number generator configured to generate a random noise signal comprising random numbers for each of the plurality of sub-frames;

a random number selector configured to select a pre-determined percentage of the highest-amplitude random numbers of the random noise signal for each of the plurality of sub-frames;

a random number selector and multiplier configured to scale the selected highest-amplitude random numbers by the recovered gains for each sub-frame to produce a scaled random noise signal;

a band-pass filter and first shaping filter to filter and shape the scaled random noise signal; and a second shaping filter configured to select a second filter based on a received filter selection indicator and further shape the scaled random noise signal with the selected filter.

29. The decoder of claim 28, comprising a post-filter configured to further filter the scaled random noise.

30. The decoder of claim 28, wherein the random number selector configured to select a pre-determined percentage of the highest-amplitude random numbers of the random noise signal is further configured to select twenty five percent of the highest-amplitude random numbers.

31. A speech coder for decoding unvoiced segments of speech, comprising:

means for recovering quantized gains partitioned into sub-frame gains from received indices associated wit each sub-frame;

means for scaling a percentage of random noise associated with each sub-frame by the indices associated with the sub-frame;

means for performing a first filtering of the scaled random noise;

means for receiving a filter selection indicator and selecting one of a plurality of filters in accordance with the filter selection indicator; and means for performing a second filtering of the filtered, scaled random noise using the selected filter.

32. The speech coder of claim 31, comprising means for further filtering the scaled random noise.

33. The speech coder of claim 31, wherein the means for scaling a percentage of random noise associated with each sub-frame further comprises means for scaling 25% of random noise associated with each sub-frame.

34. A speech coder for decoding unvoiced segments of speech, comprising:

a gain de-quantizer configured to recover quantized gains partitioned into sub-frame gains from received indices associated with each sub-frame;

a random number selector and multiplier configured to scale a percentage of random noise associated with each sub-frame by the indices associated with the sub-frame;

a first shaping filter configured to perform a first perceptual filtering of the scaled random noise; and a plurality of secondary filters, wherein a received filter selection indicator is used to select one filter from the plurality of secondary filters and the selected filter is for performing a second filtering of the filtered, scaled random noise.

35. The speech coder of claim 34, comprising a post-filter for further filtering the scaled random noise.

36. The speech coder of claim 34, wherein the random number selector and multiplier configured to scale a percentage of random noise associated with each sub-frame further is configured to scale 25% of random noise associated wit each sub-frame.

* * * * *